United States Patent [19]

Patterson et al.

[11] Patent Number: 4,552,649

[45] Date of Patent: Nov. 12, 1985

[54] FLUID COKING WITH QUENCH ELUTRIATION USING INDUSTRIAL SLUDGE

[75] Inventors: Ann D. Patterson, Vacaville, Calif.; Wayne M. Kachel, Plainfield, N.J.

[73] Assignee: Exxon Research and Engineering Co., Florham Park, N.J.

[21] Appl. No.: 712,181

[22] Filed: Mar. 15, 1985

[51] Int. Cl.[4] ..... C10G 9/32; C10G 17/00

[52] U.S. Cl. ..... 208/127; 208/13; 208/161; 585/240

[58] Field of Search ..... 208/127, 13, 161, 159; 585/240

[56] References Cited

U.S. PATENT DOCUMENTS

| | | | |
|---|---|---|---|
| 1,996,692 | 4/1935 | von Piotrowski | 208/13 |
| 2,066,166 | 12/1936 | Strezynski et al. | 208/13 |
| 2,151,147 | 3/1939 | Piotrowski et al. | 208/13 |
| 2,172,784 | 9/1939 | Bauer et al. | 208/13 |
| 2,953,520 | 9/1960 | Boisture | 208/127 |
| 2,999,062 | 9/1961 | Henderson | 208/127 |
| 3,043,771 | 7/1962 | Bloch | 208/13 |
| 3,206,392 | 12/1971 | Scheuermann et al. | 208/127 |
| 3,917,564 | 11/1975 | Meyers | 208/131 |
| 4,118,281 | 10/1978 | Tsa | 201/2.5 |
| 4,264,453 | 4/1981 | Mradvich | 208/13 |

*Primary Examiner*—D. E. Gantz
*Assistant Examiner*—Anthony McFarlane
*Attorney, Agent, or Firm*—Marthe L. Gibbons

[57] ABSTRACT

An improved fluid coking process is provided in which an aqueous sludge comprising an organic waste is used as quench in a quench elutriator to cool the coke product and convert at least a portion of the organic waste to a vaporous compound (e.g., hydrocarbon) which is recycled to the heating zone to increase the fuel value of the heating zone gaseous effluent.

9 Claims, 1 Drawing Figure

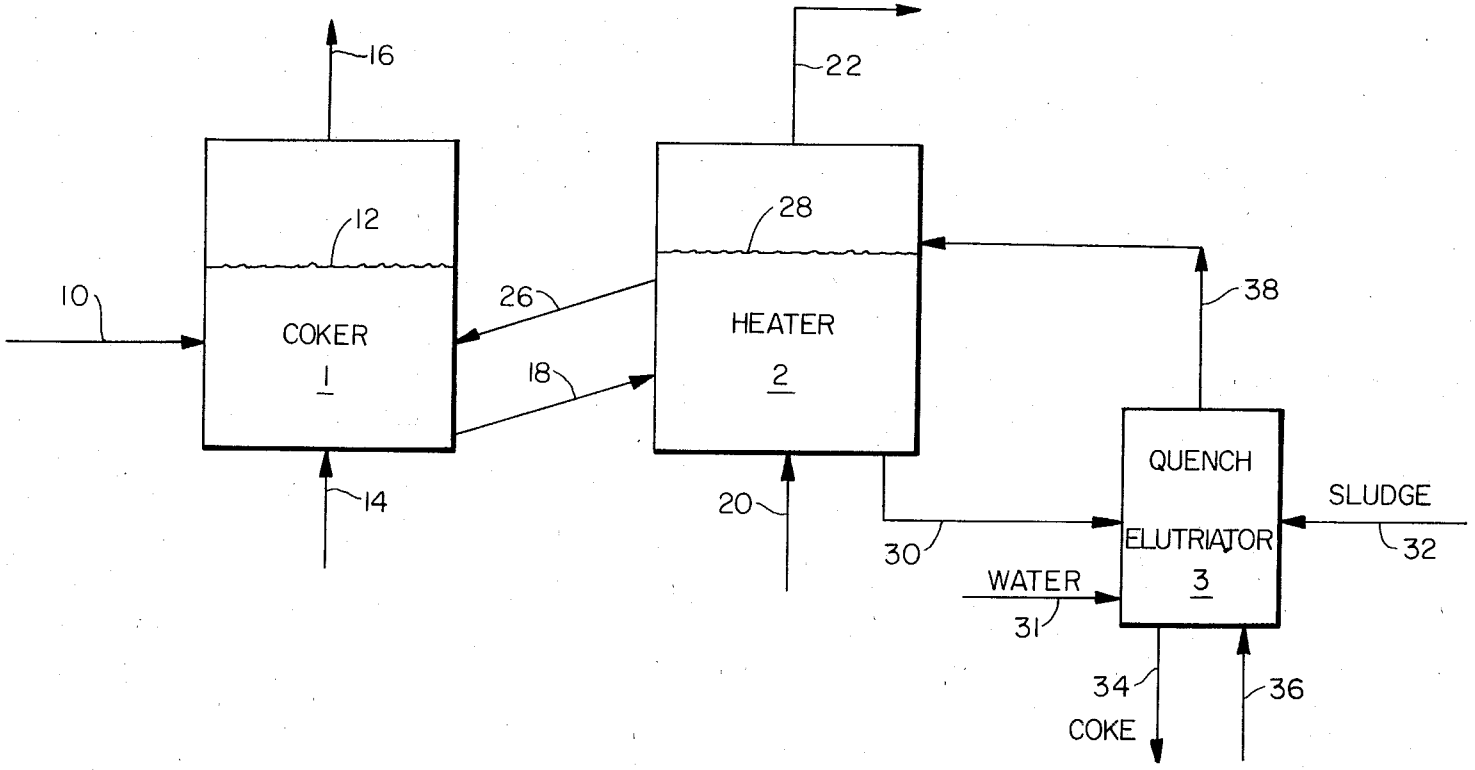
SLUDGE
32
QUENCH
ELUTRIATOR
3
36
38
34
COKE
WATER
31
30
22
28
HEATER
2
20
26
18
16
12
COKER
1
14
10

FLUID COKING WITH QUENCH ELUTRIATION USING INDUSTRIAL SLUDGE

BACKGROUND OF THE INVENTION

1. Field of the Invention

This invention relates to an improvement in a fluid coking process.

2. Description of Information Disclosures

Fluid coking is a well known process which may be carried out with or without recycle of the heavier portions of the fluid coking zone effluent. As is well known in the art, the fluid coking process, as shown, for example, in U.S. Pat. No. 2,881,130, which is hereby incorporated by reference, uses a fluid coking vessel and an external heating vessel. A fluid bed of solids, preferably coke particles produced by the process having a size in the range from about 40 to about 1000 microns is contained in the coking zone by the upward passage of fluidizing gas, usually steam, injected at a superficial velocity usually between 0.3 and 5 feet/sec. The temperature in the fluid coking bed is maintained in the range of 850° to about 1,400° F., preferably between 900° and 1,200° F. by circulating solids (coke) to the heating vessel and back. The heavy oil to be converted is injected into the fluid bed and upon contact with the hot solid undergoes pyrolysis evolving lighter hydrocarbon products in vapor phase, including normally liquid hydrocarbons and depositing a carbonaceous residue (coke) on the solids. The turbulence of the fluid bed normally results in substantially isothermal reaction conditions and thorough and rapid distribution of the heavy injected oil. The feed rate and temperature are controlled to maintain the bed in a fluidized state. Product vapors, after removal of entrained solids, are withdrawn overhead from the coking zone and sent to a scrubber and fractionator for cooling and separation.

U.S. Pat. No. 3,206,392 discloses a fluid coking process in which a stream of coke is removed from the burner and passed to a quench elutriator to separate and cool the larger coke particles from the smaller coke particles.

U.S. Pat. No. 4,118,281 discloses recycling organic waste to a fluid coker. The organic waste and coker feed oil are first heated to form a pitch-like composition that is charged to the coker.

U.S. Pat. No. 3,917,564 discloses adding sludge and other organic industrial wastes to a delayed coker as an aqueous quench medium. The water content of the sludge is utilized to cool the coke.

It has now been found that utilizing an aqueous industrial sludge containing organic wastes as quench medium in the elutriation zone produces an effluent having an increased fuel value due to the presence of the volatilzed organic materials derived from the solid organic waste.

SUMMARY OF THE INVENTION

In accordance with the invention there is provided in a fluid coking process comprising the steps of: (a) contacting a carbonaceous chargestock having a Conradson carbon content of at least about 5 weight percent with hot fluidized solids in a fluidized coking bed contained in a coking zone maintained in a fluidized state by the introduction of a fluidizing gas to produce a vapor phase product and coke which deposits on said fluidized solids; (b) introducing a portion of said solids with a coke deposit thereon into a heating zone to heat said portion of solids; (c) recycling a first portion of heated solids from said heating zone to said coking zone; (d) passing a second portion of said heated solids from said heating zone to an elutriation zone to separate larger particles from smaller particles of said solids; (e) introducing a cooling agent into said elutriation zone to cool said larger solid particles; (f) passing the vaporous effluent of said elutriation zone to said heating zone, said vaporous effluent comprising steam and said entrained smaller solid particles; the improvement which comprises: said cooling agent comprising an aqueous sludge comprising an organic waste to produce steam and convert at least a portion of said organic waste to a vaporous organic compound, and passing said vaporous organic compound to said heating zone.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a carbonaceous chargestock having a Conradson carbon content of at least about 5 weight percent is passed by line 10 into a coking zone 1 in which is maintained a fluidized bed of solids (e.g., coke particles of 40 to 1000 microns in size) having an upper level indicated at 12. Suitable carbonaceous chargestocks for the fluid coking stage of the present invention include heavy hydrocarbonaceous oils, heavy and reduced petroleum crudes, petroleum atmospheric distillation bottoms; petroleum vacuum distillation bottoms; pitch; asphalt; bitumen; other heavy hydrocarbon residues; tarsand oil; shale oil; liquid products derived from coal liquefaction processes, including coal liquefaction bottoms; coal; coal slurries; and mixtures thereof. Typically such feeds have a Conradson carbon residue of at least about 5 weight percent, generally from about 5 to about 50 weight percent, preferably from above about 7 weight percent (as to Conradson carbon residue, see ASTM Test D189-65). A fluidizing gas is admitted to coker 1 by line 14 in an amount sufficient to maintain a superficial gas velocity in the range of about 0.3 to about 5 ft./sec. The fluidizing gas may comprise steam, gaseous hydrocarbons, vaporized normally liquid hydrocarbons; hydrogen, hydrogen sulfide and mixtures thereof. Preferably, the fluidizing gas will comprise steam. Coke at a temperature above the coking temperature, for example, at a temperature of 100° to 1000° F. in excess of the actual operating temperature of the coking zone is admitted to coker 1 by line 26 in an amount sufficient to maintain the coking temperature in the range of about 850° to about 1400° F., preferably in the range of about 900° to about 1200° F. The total pressure in the coking zone is maintained in the range of about 0 to about 150 pounds per square inch gauge (psig), preferably in the range of about 5 to about 100 psig. The lower portion of the coker serves as a stripping zone to remove occluded hydrocarbons from the solids. The vaporous products include gaseous hydrocarbons and normally liquid hydrocarbons as well as other gases which were introduced into the coker as fluidizing gas. The vapor phase product is removed from coker 1 by line 16 for scrubbing and fractionation in a conventional way. If desired, at least a portion of the vaporous effluent may be recycled to the coker as fluidizing gas. A stream of heavy materials condense from the vaporous coker effluent may be recycled to the coker or the coker may be operated in a once-through manner, that is, without recycle of the heavy material of the coker.

A stream of stripped coke (commonly called "cold coke") is withdrawn from the coker by line 18 and introduced into a fluid bed of hot coke having a level 28 in heater 2. The heater may be operated as a conventional coke burner, such as disclosed in U.S. Pat. No. 2,881,130. When the heater is operated as a burner, an oxygen-containing gas, typically air, is introduced into heater 2 by line 20. The combustion of a portion of the solid carbonaceous deposition on the solids with the oxygen-containing gas provides the heat required to heat the colder particles. The temperature in the heating zone (burning zone) is suitably maintained in the range of about 1200° to about 1700° F. Alternatively, heater 2 can be operated as a heat exchange zone such as disclosed in U.S. Pat. Nos. 3,661,543; 3,702,516; and 3,759,676, the teachings of which are hereby incorporated by reference. A portion of hot coke is removed from the fluidized bed and recycled to the coker by line 26 to supply heat thereto. Another stream of heated coke comprising smaller particles (coke fines) and larger particles is passed by line 30 into quench elutriator 3. The quench elutriator may be any known type of quench elutriator suited to separate smaller particles from larger particles. For example, the quench elutriator may be one such as described in U.S. Pat. No. 3,206,392, the teachings of which are hereby incorporated by reference. The operating conditions in the elutriator may vary widely depending on the size of the particles that are desired to be separated as fines. An elutriation gas, such as steam, is introduced by line 36 into elutriator 3 to separate, by entrainment, the smaller solid particles from the larger solid particles present in the elutriation zone. Suitable elutriation gas velocity may range from about 3 ft./sec. to remove 150 microns in diameter particles to about 30 ft./sec., if solids to be carried overhead are to include particles of about 1000 microns in diameter. The solid feed rate to gas rate for the elutriator described in U.S. Pat. No. 3,206,392 is stated to be suitably as follows:

TABLE I

| Gas Velocity/sec. | Rate of Coke Feed Rate to Gas Rate lb./cu. ft. |
|---|---|
| 4 | 0.05–0.075 |
| 5 | 0.075–0.125 |
| 6 | 0.125–0.20 |
| 8 | 0.15–0.25 |
| 10 | 0.25–0.35 |

The larger solid particles fall towards the bottom of the elutriator. Typically a quench liquid such as water is introduced to the bottom of elutriator to cook the larger particles before they are withdrawn from the elutriator. In accordance with the present invention, at least a portion of the cooling agent is an aqueous sludge comprising an organic waste. The sludge is introduced by line 32 as quench (cooling agent) into elutriator 3. Preferably, a separate additional stream of water such as stream 31 is also introduced into the elutriator. The sludge may comprise from about 1 to about 15, preferably from about 5 to about 12, weight percent organic waste. The organic waste may be a solid, semi-solid or liquid material. The organic material is preferably a hydrocarbonaceous material, although it may suitably be other organic materials that can be volatilized to produce vaporous hydrocarbons. Preferably, the aqueous sludge is an industrial sludge derived from waste water treating plants of petroleum refineries and petrochemical plants comprising hydrocarbonaceous materials. A typical waste water sludge is shown in Table II.

TABLE II

| Constituents | Amount, wt. % |
|---|---|
| Organic materials | 5 |
| Inorganic materials | 7 |
| Water | 88 |

In the elutriator, contact of the water present in the aqueous sludge with the hot particles converts the water to steam while it simultaneously volatilizes at least a portion of the organic waste to vaporous organic materials, such as hydrocarbon vapors. The non-volatilized organic materials become associated with the coke particles. The quenched larger solid particles (coke particles) are removed from elutriator 3 by line 34. The effluent of the elutriator 3 is removed by line 38. The effluent comprises smaller solid particles that were separated from the larger particles in elutriator 3, steam and the volatilized portion of the organic waste, that is, the organic vapors. The elutriation zone effluent is passed by line 38 into heating zone 2 to mix with the gases that emanante from the heating zone bed. The effluent of heater 2 is removed by line 22. Since this effluent comprises the organic vapors that had been produced in the quench elutriator, this effluent has a greater fuel value. The effluent of line 22, usually after conventional separation of entrained solid fines, may be used as fuel, for example, in a CO furnace.

The following example is presented to illustrate the invention.

EXAMPLE

A sludge at a temperature of 60° F. containing 5 wt.% organic material was introduced into a quench elutriator at a feed rate of 3 gallons per minute (gpm). A separate water stream, at a temperature of 100° F., was also introduced at a rate of 22 gpm. The coke stream entering at a rate of 1528 lb/minute was cooled from 1225° F. to 400° F. As a result of using the sludge as quenching agent, the energy content of the effluent from the quench elutriator was increased by 32 million BTU per day. Also, an additional 2,000 lb/day of coke was produced.

What is claimed is:

1. In a fluid coking process comprising the steps of:

(a) contacting a carbonaceous chargestock having a Conradson carbon content of at least about 5 weight percent with hot fluidized solids in a fluidized coking bed containing a coking zone maintained in a fluidized state by the introduction of a fluidized gas to produce a vapor phase product and coke which deposits on said fluidized solids;

(b) introducing a portion of said solids with a coke deposit thereon into a heating zone to heat said portion of solids;

(c) recycling a first portion of heated solids from said heating zone to said coking zone;

(d) passing a second portion of said heated solids from said heating zone to an elutriation zone to separate larger particles from smaller particles of said solids;

(e) introducing a cooling agent into said elutriation zone to cool said larger solid particles;

(f) passing the vaporous effluent of said elutriation zone to said heating zone, said vaporous effluent comprising steam and said entrained smaller solid particles;

the improvement which comprises: said cooling agent comprising an aqueous sludge comprising an organic waste to produce steam and convert at least a portion of said organic waste to a vaporous organic compound, and passing said vaporous organic compound to said heating zone.

2. The process of claim 1 wherein said heating zone is a burning zone and wherein a molecular oxygen-containing gas is introduced into said burning zone.

3. The process of claim 1 wherein said aqueous sludge comprises from about 1 to about 15 weight percent of said organic waste.

4. The process of claim 1 wherein said organic waste is a hydrocarbonaceous material.

5. The process of claim 1 wherein said aqueous sludge is an industrial sludge derived from a waste water treating plant of a petroleum refinery or a petrochemical plant.

6. The process of claim 1 wherein said coking zone is maintained at a temperature ranging from about 850° F. to about 1400° F.

7. The process of claim 1 wherein said heating zone is operated at a temperature ranging from about 100 to about 1000 Farenheit degrees in excess of the actual operating temperature of said coking zone.

8. The process of claim 1 wherein said cooling agent additionally comprises a separate stream of water.

9. The process of claim 1 wherein said vaporous organic compound is a hydrocarbon.

* * * * *